US011136731B2

(12) United States Patent
Poole et al.

(10) Patent No.: US 11,136,731 B2
(45) Date of Patent: Oct. 5, 2021

(54) INTEGRATED FORM FOR EMBEDDING A WATERSTOP IN A KEYED CONCRETE JOINT

(71) Applicants: David R. Poole, Temecula, CA (US); Steven Joseph Potter, Oceanside, CA (US)

(72) Inventors: David R. Poole, Temecula, CA (US); Steven Joseph Potter, Oceanside, CA (US)

( * ) Notice: Subject to any disclaimer, the term of this patent is extended or adjusted under 35 U.S.C. 154(b) by 0 days.

(21) Appl. No.: 16/684,281

(22) Filed: Nov. 14, 2019

(65) Prior Publication Data

US 2021/0148125 A1 May 20, 2021

(51) Int. Cl.

| | |
|---|---|
| ***E01C 23/02*** | (2006.01) |
| ***E01C 23/04*** | (2006.01) |
| ***E04G 11/36*** | (2006.01) |
| *E01C 11/06* | (2006.01) |

(52) U.S. Cl.

CPC ..... *E01C 23/023* (2013.01); *E01C 23/045* (2013.01); *E04G 11/36* (2013.01); *E01C 11/06* (2013.01)

(58) Field of Classification Search

CPC ..... E01C 23/021; E01C 23/023; E01C 11/10; E01C 11/106; E01C 11/04; E01C 11/06; E01C 11/08; E01C 11/12; E01C 11/123; E01C 11/126; E01C 23/045

USPC ..... 249/9; 404/48, 50, 51, 56, 64, 65, 69

See application file for complete search history.

(56) References Cited

U.S. PATENT DOCUMENTS

| | | | | | |
|---|---|---|---|---|---|
| 1,723,306 | A | * | 8/1929 | Sipe | E04B 1/615 52/396.04 |
| 1,731,334 | A | * | 10/1929 | Fischer | E01C 11/10 404/40 |
| 2,098,292 | A | * | 11/1937 | Jacobson | E01C 11/12 404/60 |
| 2,223,083 | A | * | 11/1940 | Malcom | E01C 11/126 404/49 |
| 2,772,468 | A | * | 12/1956 | Heltzel | E04G 13/00 249/3 |
| 2,961,731 | A | * | 11/1960 | Buzzell | E02B 7/10 264/35 |
| 3,297,800 | A | * | 1/1967 | Bradley | E04B 1/6807 264/34 |
| 3,440,934 | A | * | 4/1969 | Dill | E01C 11/02 404/74 |

(Continued)

FOREIGN PATENT DOCUMENTS

| | | | | |
|---|---|---|---|---|
| DE | 747581 C | * | 10/1944 | E01C 11/08 |
| DE | 202013103285 U1 | * | 9/2013 | E01C 11/126 |

(Continued)

OTHER PUBLICATIONS

Sika USA: PVC Waterstop Master Specification. (Year: 2014).*

*Primary Examiner* — Michael Safavi

(74) *Attorney, Agent, or Firm* — Anderson Law; Owen J. Bates

(57) ABSTRACT

Disclosed herein is an article of manufacture that increases the efficiency of forming a building material having a keyed joint with a waterstop imbedded within the building material. The article allows the easy formation of a keyed joint between formed solid slabs (typically concrete) with a waterstop properly imbedded between the slabs.

12 Claims, 7 Drawing Sheets

(56) References Cited

U.S. PATENT DOCUMENTS

| | | | | | |
|---|---|---|---|---|---|
| 3,567,171 | A * | 3/1971 | Slominski | B28B 7/0079 | 249/9 |
| 3,693,928 | A * | 9/1972 | Shoemaker | E04G 11/365 | 249/18 |
| 3,956,557 | A * | 5/1976 | Hurst | E04B 1/6806 | 428/167 |
| 6,471,441 | B1 * | 10/2002 | Muller | E01C 11/14 | 404/47 |
| 6,893,187 | B2 * | 5/2005 | Lehto | E01C 11/123 | 404/47 |
| 8,511,931 | B2 * | 8/2013 | Klotz | E01C 5/005 | 404/40 |

FOREIGN PATENT DOCUMENTS

| | | | | |
|---|---|---|---|---|
| EP | 194970 | A1 * | 9/1986 | E01C 11/14 |
| EP | 2829657 | A1 * | 1/2015 | E01C 11/126 |
| WO | WO-9828500 | A1 * | 7/1998 | E01C 11/106 |
| WO | WO-02063115 | A1 * | 8/2002 | E04F 15/14 |

* cited by examiner

INTEGRATED FORM FOR EMBEDDING A WATERSTOP IN A KEYED CONCRETE JOINT

I. BACKGROUND OF THE INVENTION

One of the major design concerns in any construction project is the exposure of the various construction materials to water (see https://www.greenbuilt.org/the-top-3-ways-that-water-destroys-our-homes-and-buildings/). Exposure to water causes dry rot and promotes the growth of mold. There are a large number of products that are available to deal with water exposure. Lumber can be treated with various chemicals to deter rot. Substitute man-materials can be all or part of the material that goes into decking, molding, fascia, and trim boards, and other construction materials.

Not only is water exposure a concern for the structural integrity of a building, but wet or moist conditions support the propagation of mold which is a serious health issues for the occupants of the building.

Mold is a type of fungus that grows very well in warm and often wet or moist environments. Mold can grow in or on dirt, paper, the outer covering of dry wall sheathing products, plywood, oriented strand board, MDF and the framing lumber used in construction. Molds can release toxigenic materials, referred to mycotoxins, which can be harmful to persons including those with compromised immune systems or pulmonary issues such as cystic fibrosis.

In addition to using water and mold resistant building materials, a whole industry has arisen which provides innumerable flashing and sealing products that can be applied to all types of framing lumber and sheathing. Sealing products can be wide flexible adhesive tape which can encase window framing. Liquid applied coatings can be applied which dry to a continuous flexible coating around window frames, door frames, sill plates and other vulnerable locations within a building.

In addition flashing can be installed at various locations such a roof valleys, chimney and skylights. As defined at Dictionary.com flashing are "pieces of sheet metal or the like used to cover and protect certain joints and angles, as where a roof comes in contact with a wall or chimney, especially against leakage."

Concrete is a ubiquitous material that is often used for floors (slab on grade) and for walls, typically for light industrial buildings as a tilt-up building. But concrete cannot be poured in huge sections. It must be poured in smaller sections with a concrete joint between the sections. A concrete joint controls the possibilities of cracks forming after the concrete has cured. Concrete joints provide a means to account for the expansion and contraction of the concrete caused by temperature and other environmental factors. A consequence of utilizing concrete joints is that water can leak between the sections in a slab and increase the water pressure underneath the floor if it is a slab on grade situation. Concrete joints also allow water to penetrate an exterior vertical wall and expose the interior building material to water.

I. A. Waterstops

Sealing products called waterstops, are used between the two different pours of concrete. Waterstops (see https://en.wikipedia.org/wiki/Waterstop) can be manufactured with many different types of materials to repel water.

Waterstops are typically long flat pieces of flexible material. A typical waterstop might have a width of 4"-9". Typical thickness could be ¼" to ½" and have a length, as sold commercially, of 10 feet to 50 feet. Typical waterstops have ribbing or barbs molded into two sections running the length of the waterstop located along the two outer edges and each extending inwards towards the center of the waterstop with a relatively smooth, rib-free portion, running length-wise along center of the waterstop.

Waterstops are designed to be used with joints that both move (dilation joints) and joints that don't move (construction cold joints). Waterstops of dilation joints typically have a tubular channel running down the center of the length of the waterstop. The tubular channel can be flexed and deformed if the two sides of the joint move in relation to each other.

Waterstops for construction cold joints typically have a flat smooth center web section which is typically positioned at a joint between the two slabs which are poured at different times. In addition, cold construction joints are often poured with a dove tail type of keyed joint (keyway) between the sections of concrete which are poured at different times.

I. B. Installation of Typical Waterstop without Keyway

Conventional concrete forms typically include a manually constructed mesh work of rebar which is constructed to be positioned roughly in the middle of a concrete section which is being poured. Rebar, or reinforcing bar, is typically made of steel but is also made of stainless steel, glass fiber, carbon fiber, galvanized steel and other specialized material. It is typically round and available in sizes of ⅜" to 2⅛" in ⅛" increments and has surface irregularities which promote increase bonding with the concrete.

The rebar mesh is supported so that it is positioned roughly within the center of the concrete section being poured. If a waterstop is to be incorporated in a section of concrete then one side of the waterstop is sandwiched between two form boards with approximately one-half of the width of the waterstop encased between the form boards and the other half exposed. The exposed half of the waterstop has to be suspended so that it lays more or less perpendicular to the joint that will be formed between the two sections of concrete. The waterstop is suspended by supporting it with wires, straps and the like to the rebar mesh. After the first section has been poured and allowed to cure, the two form boards holding the waterstop are removed along with any other form boards that were involved in the pour. Now the second half of the waterstop is exposed, extending perpendicularly from the edge of the concrete section just poured. Again, the exposed waterstop (the other half) must be suspended to the rebar in a situation similar to when the first concrete section was poured. After the second section of concrete has been poured, the waterstop is securely embedded within the concrete and spanning the joint between the two poured sections of concrete.

I. C. Waterstop with a Keyway

If a keyway is to be included, then additional work must be done to form boards. A keyway is an interlocking mechanism formed as a pair of concrete structures between two adjacent slabs of concrete. Typically, the form used along the common side of the first poured slab includes a longitudinal protrusion that runs the length of the form board. When the concrete is poured it causes a trough in the concrete to be formed along the common edge of the just poured concrete slab. If the first concrete slab is allowed to cure sufficiently, when the second concrete slab is poured, then the concrete slurry will fill in the trough that was formed in the first slab. Once the second concrete slab is poured, the interlocking structures hold both slabs together, eliminating or reducing the vertical shifting of the two slabs with respective to one another.

It is a common practice to incorporate both a keyed interlocking joint with a waterstop. This is accomplished by incorporating one half of the keyed protrusion along the bottom portion of an upper form board and a second half of the keyed protrusion along the upper portion of the lower form board. Then the waterstop is sandwiched between the two form boards and the installation process proceeds as described above.

This results in the waterstop being embedded in the middle of the keyed interlocking joint, an example of which is shown in FIG. 3D.

II. BRIEF SUMMARY OF THE INVENTION

The present invention provides a single formed product which enables the embedding of a waterstop and the formation of a keyed joint at the construction joint between the slabs of concrete. Though described herein as being used in the creation of a slab-on-grade, the same and/or similar principles and techniques can be used to embed a waterstop in a keyed vertical section (wall) of concrete.

III. A BRIEF DESCRIPTION OF THE SEVERAL VIEWS OF THE DRAWINGS

An enhanced understanding of the present invention as well as other objects and advantages thereof will become clear upon consideration of the following detailed description especially when taken with the accompanying drawings, wherein like numerals designate like parts throughout, and wherein.

In all of the drawings, Reference Numbers below 100 refer to related articles of manufacture and are typically used in conjunction with the present invention and are not part of any embodiment of the invention. Reference numbers at or above 100 refer to various embodiments and aspect of the present invention.

IV. DETAILED DESCRIPTION OF THE INVENTION

Figure 1:
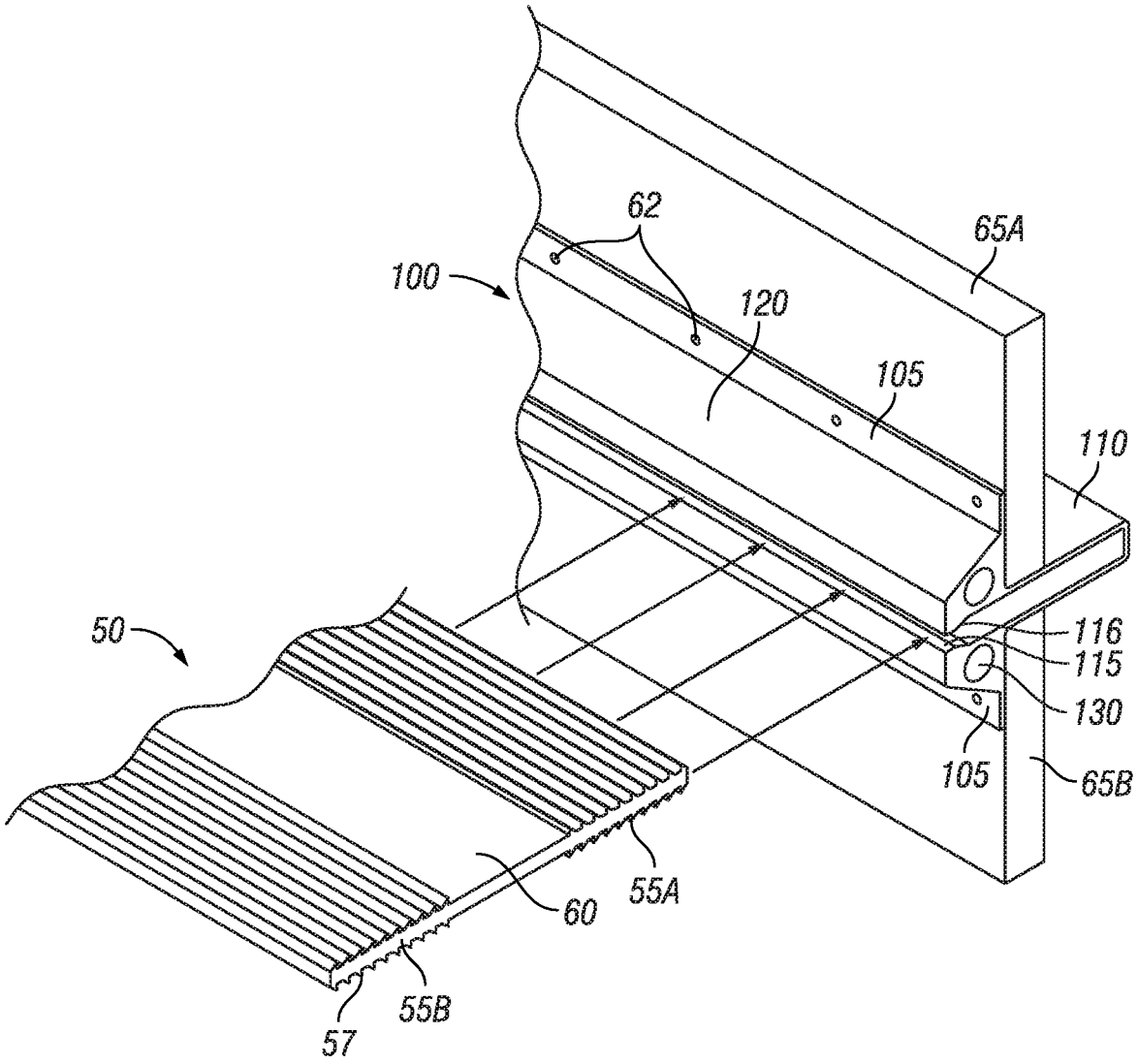
FIG. 1 is a perspective view of one embodiment of the present invention in conjunction with one example of a waterstop that would be used in conjunction with the disclosed embodiment.

FIG. 1 shows a one embodiment of an Integrated Concrete Form 100, which is single preformed article of manufacture which facilitates the formation of a keyed concrete joint with a waterstop embedded in the keyed joint. Integrated Concrete Form 100 provides i) a Pocket 110 to receive approximately one half the width of a Waterstop 50 and ii) a Protrusion 120 which will enable a Keyway 72 (see FIG. 3D) to be formed in the edge of the section of a concrete slab that is to be poured first. The first Edge 55A of a length of the Waterstop 50 is inserted longitudinally into Pocket 110 of Integrated Concrete Form 100. Both the Integrated Concrete Form 100 and Waterstop 50 can be manufactured in various lengths, typically in 10 ft. and 50 ft. lengths. They can then be cut in the field to fit the length of the concrete slab being poured. If the length of the slab is longer than the length of Integrated Concrete Form 100 or Waterstop 50 that is available, multiple lengths can be joined together. Because both the Integrated Concrete Form 100 and the Waterstop 50 are manufactured from existing and well-utilized materials, the multiple lengths can be jointed together using methods, material and machines well-known in the industry.

Form Boards 65A and 65B are attached to Integrated Concrete Form 100 as shown in FIG. 1, by driving Fasteners 62 (typically nails or screws) through both Nailing Flanges 105, located along each edge of the Integrated Concrete Form 100. Typically, nails or screws would be driven through both Nailing Flanges 105 and into Form Boards 65A and 65B, every 12-18" along the entire length of the Integrated Concrete Form 100. Once both Form Boards 65A and 65B are attached to a length of Integrated Concrete Form 100, a relatively stable structure is formed and the assembly is then placed along with the other form boards in typical manner, as needed at the pour site.

Figure 3A:
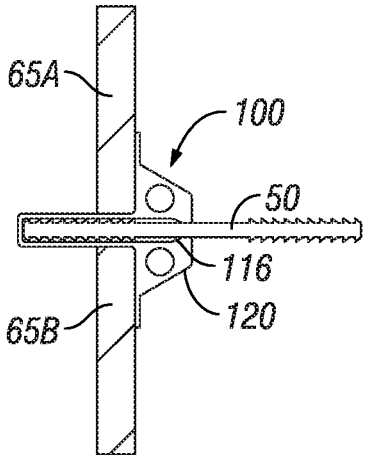
FIGS. 3A-3D show the sequence of steps needed to utilize the present invention.
Figure 3B:
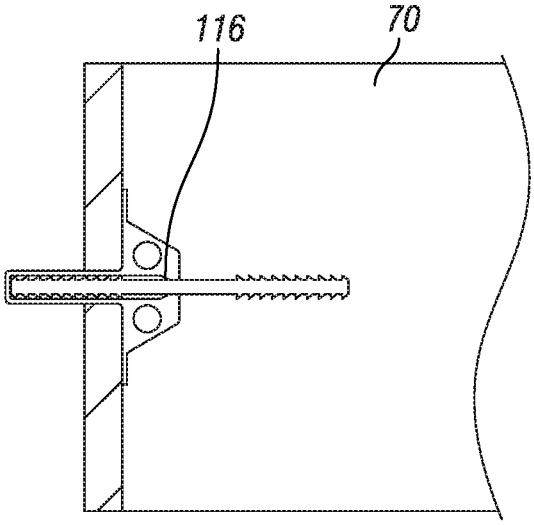
Figure 3C:
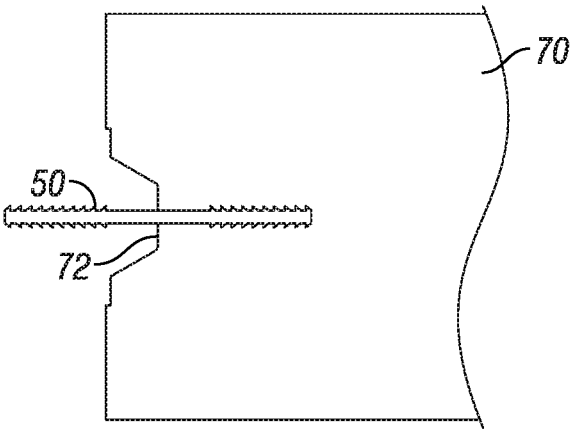

After the concrete for the first pour has set, the Integrated Concrete Form 100 and associated Form Boards 65A and 65B will be removed, leaving the first half of the Waterstop 50 embedded in the first section of concrete (see FIG. 3C). Because the second half of the Waterstop 50 had been positioned in the Pocket 110, it will be exposed, while the first half, which had been exposed, is now entrapped within the concrete of this first pour. Then the Integrated Concrete Form 100 and associated Form Boards 65A/65B, are removed, exposing the second half 55B of the Waterstop 50 that was protected by the Pocket 110. Depending on the material used for the Integrated Concrete Form 100, a release agent may need to be applied to the surfaces of the Integrated Concrete Form 100 that will be exposed to the concrete during the first pour. Release agents are also typically applied to Form Boards 65A and 65B.

At this point, the Waterstop 50 is securely positioned by being encased within the first slab which means that it will stay properly positioned, without any further work, during the pouring of the second slab. Further, because Keyway 72 has been formed within the concrete of the first pour, there will be a mating Keyway 75 formed during the second pour. In addition, the second half of the Waterstop 50 will now be embedded in the concrete of the second pour.

This results in the very effective barrier of the Waterstop 50 being embedded in the joint between the two slabs of poured concrete.

The Integrated Concrete Form 100 provides advantages over the existing art. It provides a convenient and efficient way of positioning Waterstop 50 so that it is properly imbedded in a poured concrete section. There often is no need for any attachment points to rebar or other reinforcing materials. In addition Integrated Concrete Form 100 can be combined with Form Boards 65A and 65B to be a rigid assembly which facilitates its incorporation with other form structures and is reusable.

Figure 2:
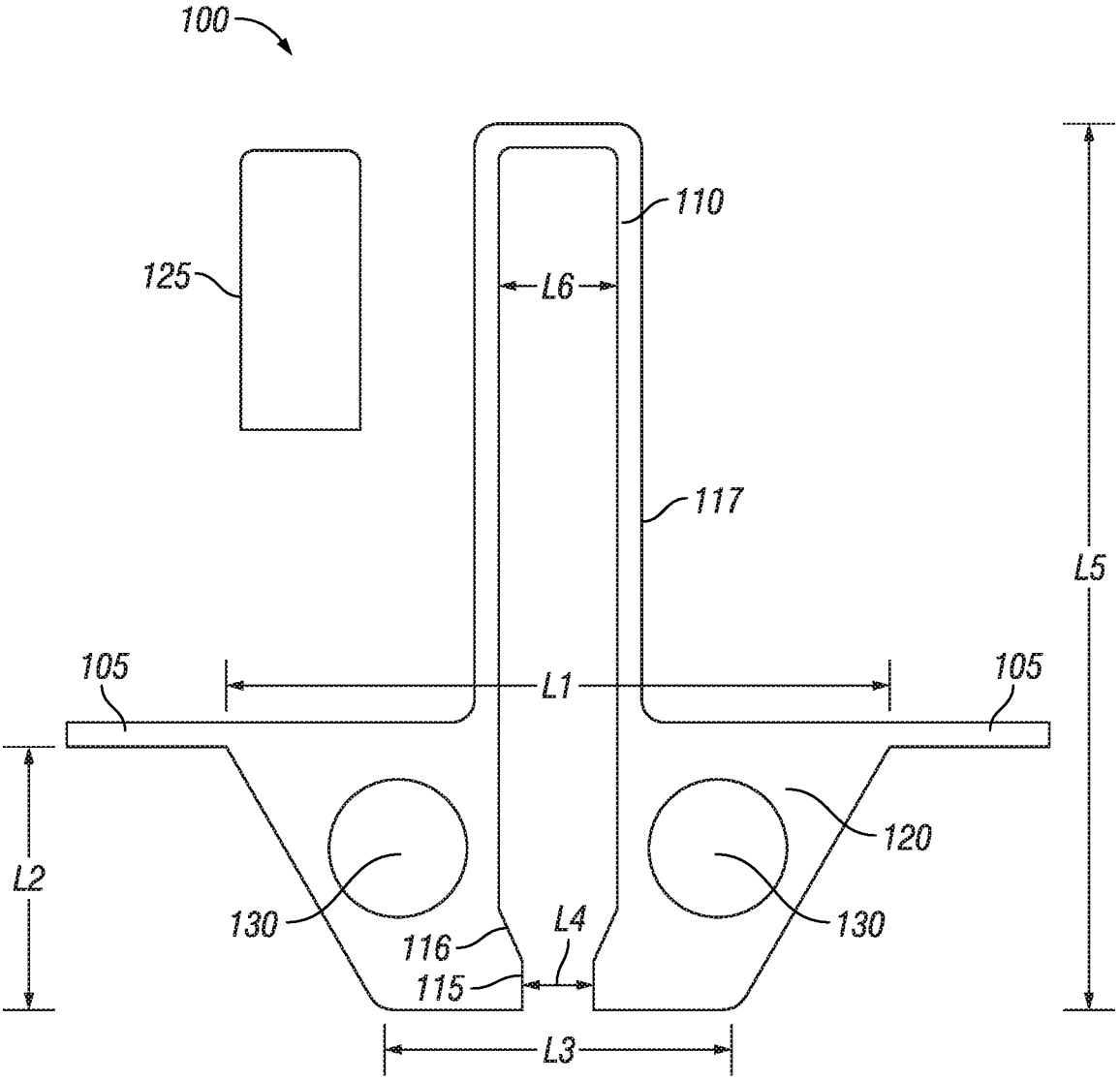
FIG. 2 is side view of one end of one embodiment of the present invention.

FIG. 2 shows an end view of the Integrated Concrete Form 100. Pocket 110 is a cavity designed to receive the long edge of Waterstop 50. Pocket 110 has a length of L5 which is measured from the top of the Protrusion 120 to the bottom of the Pocket 110, the farthest point away from the top of the Protrusion 120. It is aligned with the center of Protrusion 120. Pocket 110 has three sections along its length. At the Constriction 115, located farthest away from the closed end, Pocket 110 has a thickness of L4. This thickness is designed to fit tightly around the center Web 60 of Waterstop 50. Then there is a Transition Section 116 which is a sloped area which connects the narrow Constriction 115 with the Full Width Portion 117 of Pocket 110. Full Width Portion has a thickness L6 which is designed to fully accept the thickness of Waterstop 50 along the Edge 55A, which is thicker because of the Ribs 57 which extend out from both sides of the Waterstop 50 on along both Edges 55A and 55B.

Optional Spacer 125 is used to match up a Waterstop 50 which is smaller, i.e. narrower, than might normally be used. If the width of a particular Waterstop 50, which might be the only size available on a job site, is too narrow then there would be tendency of that narrower Waterstop 50 to move around in Pocket 110 which would be too deep. An appropriate sized Spacer 125 would be inserted into and seated all the way into Pocket 110. Then the narrower width Waterstop 50 and be securely positioned into Pocket 110 by being placed up against Spacer 125 which is seated all the way into Pocket 110.

Extending out from both sides of Pocket 100 are two Nailing Flanges 105. Nailing Flanges 105 are relatively thin. They are designed to be pierced by nails or screws thus rigidly affixing Integrated Concrete Form 100 to both Form Boards 65A and 65B. Because the Integrated Concrete Form 100 and associated Foam Boards 65A and 65B can be fully released as a single unit after the first pour, the assembly can re-used a number of times. However, if it is necessary or foreseeable that the Integrated Concrete Form 100 be reused with new, different or different sized Foam Boards 65A and 65B, then Integrated Concrete Form 100 can be attached to the Form Boards 65A and 65B using screws which would allow for the easiest and safest means of separating the Integrated Concrete Form 100 without damaging it.

Extending away from the planar surfaced defined by the Nailing Flanges 105, is Protrusion 120. Protrusion runs the length of the Integrated Concrete Form 100 and is designed to leave a trough in the edge of the first poured slab. The cross sectional shape of Protrusion 120 can be any shape which fulfils the dual need of forming a keyway which will significantly stabilize the two slabs of concrete and must permit the easy removal of the Integrated Concrete Form 100 from the edge of the First Concrete Pour 70. For example if the base of the Protrusion 120 (nearest the Nailing Flanges 105) was narrower than the top, the cured concrete of the first pour would lock the Protrusion 120 into the slab once the concrete cured. Such a shape would be unusable. Any shape from square, rectangular, triangular (base wider than top), semi-circular or scalloped in theory could be used. However, the standard used in the industry, by architects and permitting authorities, calls for the use of trapezoidal shaped keyways. Protrusion 120 has a width of L1 at is base, a thickness of L2 and a width at its top of L3.

Running the length of Integrated Concrete Form 100 are Tunnels 130. The primary purpose is simply the reduction in the amount of material that is used to form Integrated Concrete Form 100. Tunnels 130 are optional and can be up to any diameter that does not weaken the structural integrity of Integrated Concrete Form 100 by eliminating too much material from Protrusion 120.

Integrated Concrete Form 100 is preferably formed from a thermoplastic elastomer, more preferably formed from polyvinyl chloride (PVC) and most preferably from flexible PVC. In addition Integrated Concrete Form 100 is formed from material having an instantaneous Shore A durometer value of 60-100, preferably having an instantaneous Shore A durometer value of 70-90 and most preferably having an instantaneous Shore A durometer value of 80-85. All of the instantaneous Shore A values were determined according to the ASTM D2240 standard.

FIG. 3A-3D shows the actual steps in how one embodiment of the invention is utilized in actual practice. FIG. 3A shows Integrated Concrete Form 100 attached to two Form Boards 65A and 65B. Waterstop 50 has been inserted into Pocket 110 so that the Web 60 section of Waterstop 100 is positioned at the Constriction 115.

FIG. 3B shows the assembly of Integrated Concrete Form 100 with Form Boards 65A and 65B after the first Slab 70 has been poured.

FIG. 3C shows Slab 70 with the imbedded Waterstop 50 after the Integrated Concrete Form 100 and Form Boards 65A and 65B have been removed. Keyway 72 is shown in the edge of Slab 70 after the concrete was formed around Protrusion 120. Note that one-half of Waterstop 50 is now exposed and extending from Slab 70.

Figure 3D:
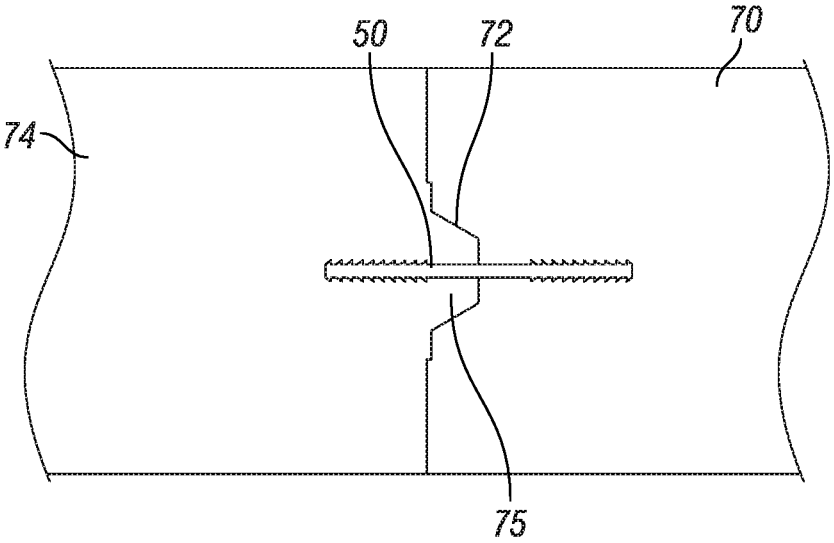

FIG. 3D shows Slab 74 after it has been poured to mate with Keyway 72 and form around the exposed half of Waterstop 50. The result is a keyed interlocked joint between Slab 72 and Slab 70 and slab 74 with the Waterstop 50 acting as a fluid barrier to prevent the flow of fluids along the joint between Slab 70 and 74.

Figure 4A:
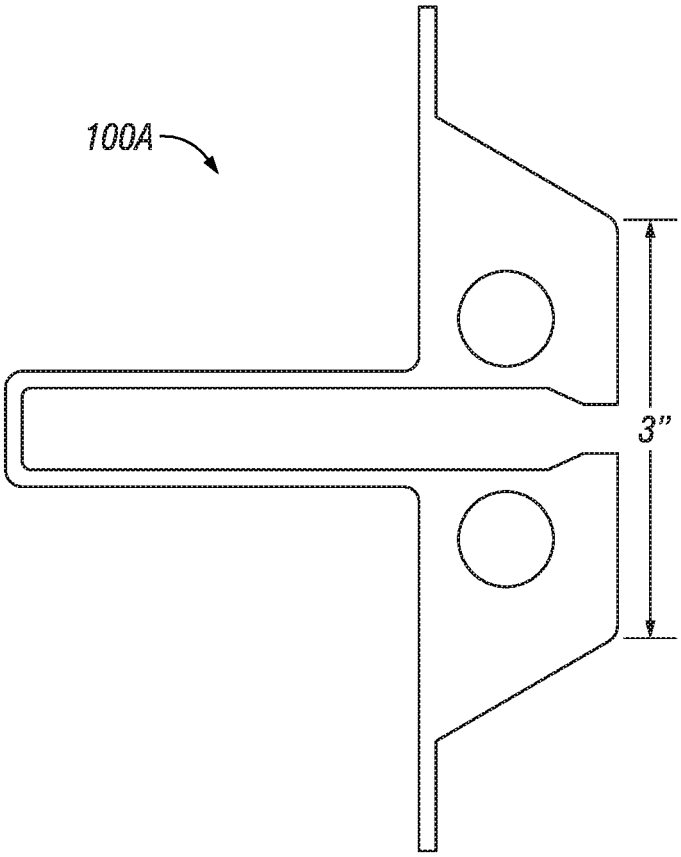
FIGS. 4A and 4B show two embodiments having different sizes.
Figure 4B:
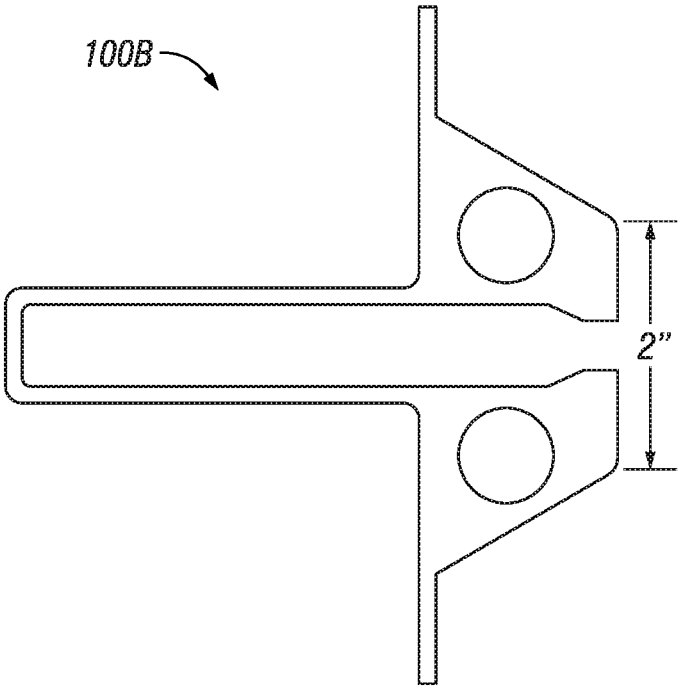

FIGS. 4A and 4B show specific embodiment of the Integrated Concrete Form 100 designed to form keyways that are 2" wide along the top of Protrusion 120 (100A) and one that is designed to form a keyway that is 3" wide along the top of Protrusion 120 (100B). Keyways having these dimensions are fairly common in the industry.

Figure 5A:
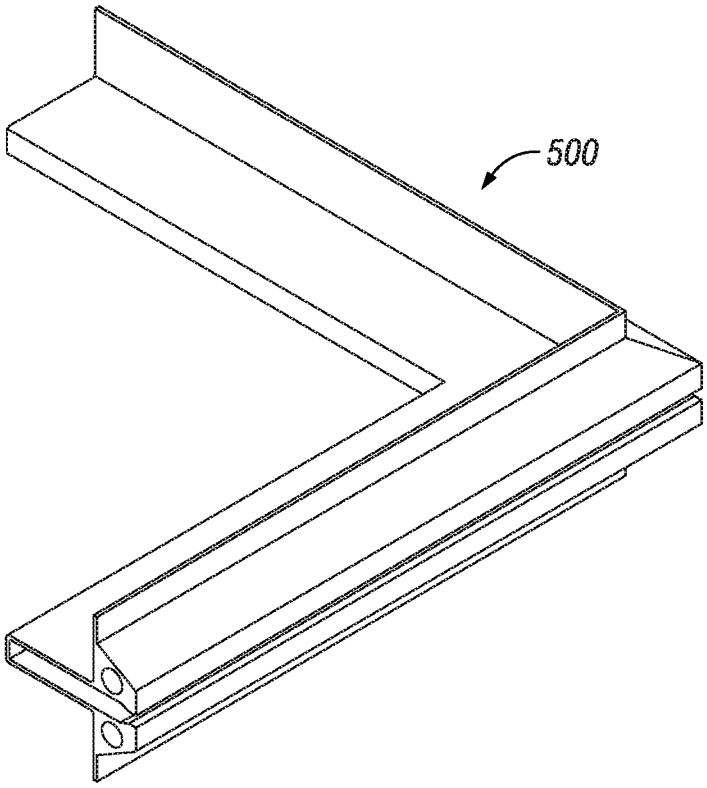
FIGS. 5A and 5B show modifications of the present invention which are used in the formation of an inside corner and outside corner.
Figure 5B:
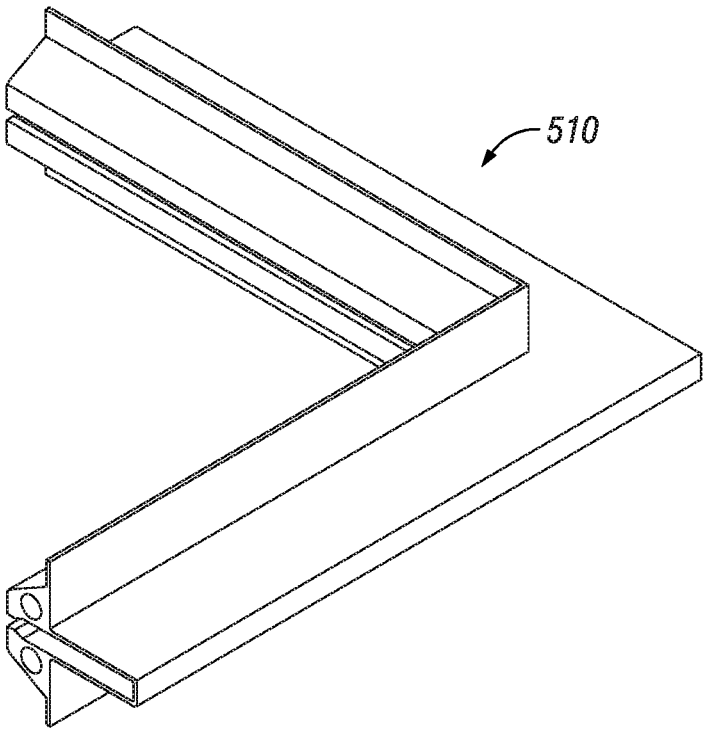

FIGS. 5A-B show embodiments of the Integrated Concrete Form 100 which are designed to form right angles. Inside Corner Former 500 and Outside Corner Former 510 can be made in the field by joining straight lengths of Integrated Concrete Form 100 by standard methods known in the industry.

Figure 6A:
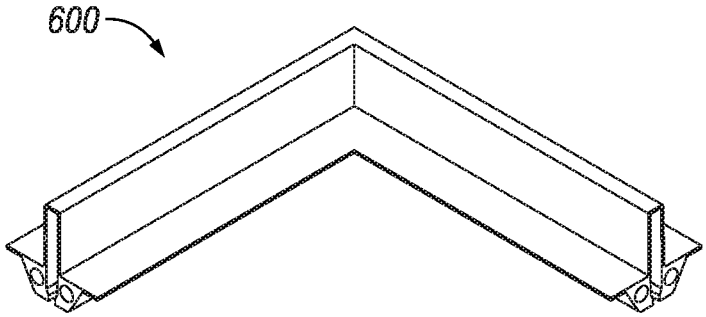
FIGS. 6A-6C show modifications of the present invention which are used in the formation of a Vertical Right Angle, a Vertical Tee Former and a Vertical Cross Former.
Figure 6B:
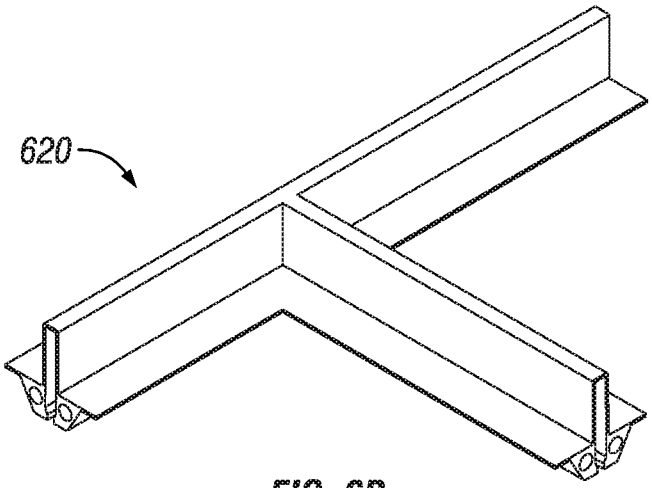
Figure 6C:
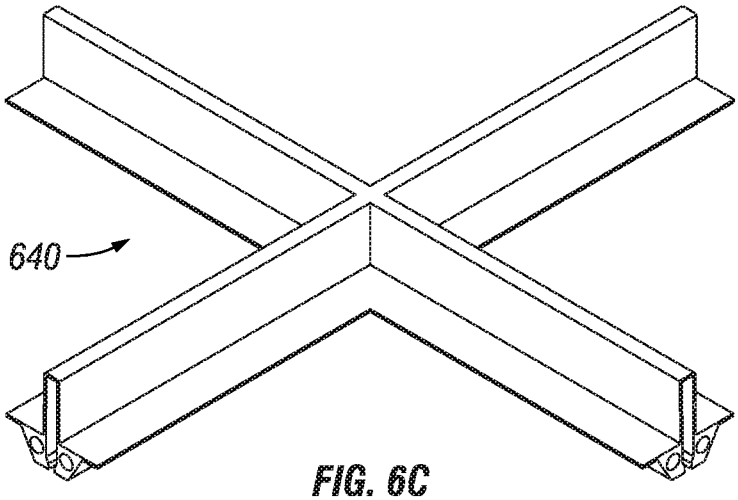

FIGS. 6A-6C show additional embodiments which are designed to form vertical right angles as might typically be used in pouring concrete walls. Vertical Right Angle Former 500, Vertical Tee Former 620 and Vertical Cross Former 640 can be made in the field by joining straight lengths of Integrated Concrete Form 100 by standard methods known in the industry.

Figure 7:
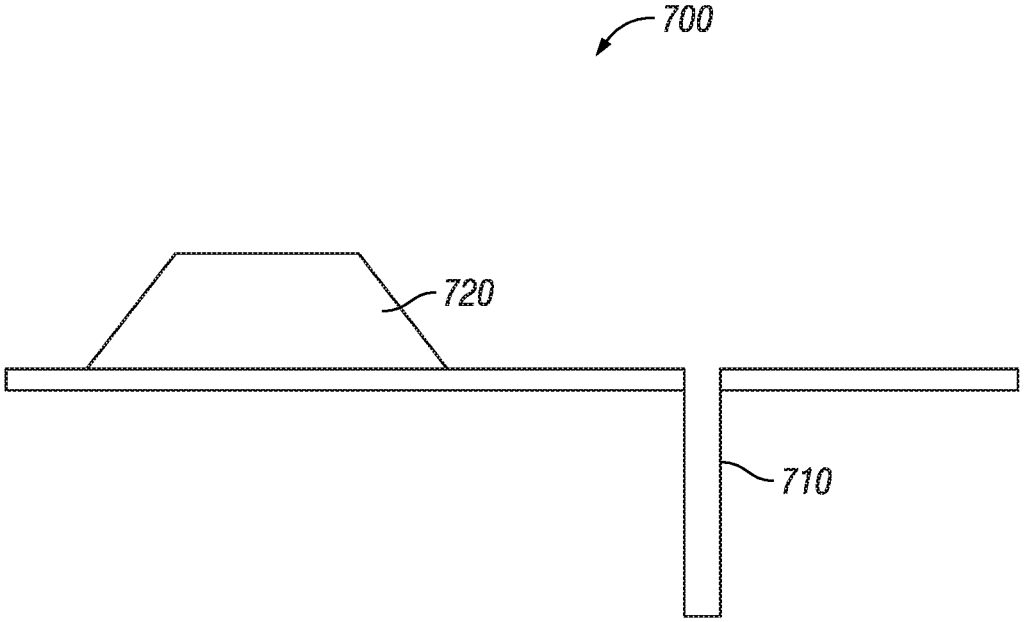
FIG. 7 shows an alternative embodiment in which the Pocket and the Protrusion are located apart from each other.

FIG. 7 shows an embodiment of the invention, Alternative Integrated Concrete Form 700 in which Pocket 710 is not aligned with the Protrusion 720. Though not as preferred as Integrated Concrete Form 100, Alternative Integrated Concrete Form 700 is within the scope of the invention.

As discussed herein, the Integrated Concrete Form 100 is used with concrete. However, it should be understood that the invention can be used with any material or combination of materials that can be prepared as a fluid slurry or powder and then added to a physical restraining structure (form), molded to fit the shape of the restraining structure and fully encasing Protrusion 120 and Pocket 110. The material must then be able to harden by any chemical, physical, or evaporate process to form a more or less solid state.

Whereas particular embodiments of the invention have been described herein for the purpose of illustrating the invention and not for the purpose of limiting the same, it will be appreciated by those of ordinary skill in the art that numerous variations of the details, materials and arrangement of elements, steps, structures, or parts may be made within the principle and scope of the invention without departing from the invention as described in the following claims.

What is claimed is:

1. An article of manufacture for forming a solid slab having both a keyed configuration and a separate embedded waterstop, said article not being embedded in the slab and comprising:

said article being elongated and having a first edge, a second edge, a width, a first side and a second side;

said article being monolithic and composed of thermoplastic;

said article further comprising a protrusion running the length of said first side of said article; said protrusion having a generally planar upper surface and a generally planar lower surface;

said article further comprising a trough running the length of said article with said trough penetrating through the protrusion and extending beyond the lower planar surface of said protrusion; said trough opening on the upper planar surface of said protrusion;

said trough having essentially straight walls along the entire length of the article with only a narrowing of the tough at the opening on the upper planer surface of said protrusion;

said trough adapted to receive the longitudinal edge of the separate waterstop within the protrusion; and said article having smooth surfaces on all sides of the article whereby the article can be removed from the slab after an initial formation of the slab.

2. An article of manufacture as described in claim 1 wherein said protrusion is disposed parallel to one of said edges.

3. An article of manufacture as described in claim 1 wherein said protrusion is disposed at the center of said article.

4. An article of manufacture as described in claim 1 wherein said trough is disposed parallel to one of said edges.

5. An article of manufacture as described in claim 1 wherein said protrusion is centered along the length of said article and parallel to the first edge of said article and wherein said trough is centered along the length of the article, parallel to said first edge and wherein the opening of said trough extends through said protrusion.

6. An article of manufacture as described in claim 5 wherein said trough has a smaller width on a portion of said trough nearest the opening of said trough.

7. An article of manufacture as described in claim 1 wherein said protrusion has a cross-sectional shape selected from the group consisting of trapezoidal, square, rectangular, triangular, circular and curved.

8. An article of manufacture as described in claim 7 wherein said protrusion has a trapezoidal cross-sectional shape.

9. An article of manufacture as described in claim 1 wherein said article has a measured hardness value in the range of 60-100 instantaneous Shore A durometers as measured according to ASTM D2240.

10. An article of manufacture as described in claim 9 wherein said article has a measured hardness value in the range of 70-90 instantaneous Shore A durometers as measured according to ASTM D2240.

11. An article of manufacture as described in claim 10 wherein said article has a measured hardness value in the range of 80-85 instantaneous Shore A durometers as measured according to ASTM D2240.

12. An article of manufacture as described in claim 1 wherein said width is between about 4" and about 9".

* * * * *